US005569138A

United States Patent [19]

Wang et al.

[11] Patent Number: 5,569,138

[45] Date of Patent: Oct. 29, 1996

[54] MULTI-PURPOSE EXERCISING APPARATUS

[75] Inventors: Leao Wang; Peter Wu, both of Taichung Hsien, Taiwan

[73] Assignee: Greenmaster Industrial Corp., Taichung Hsien, Taiwan

[21] Appl. No.: 463,285

[22] Filed: Jun. 5, 1995

[51] Int. Cl.[6] ..... A63B 21/02

[52] U.S. Cl. ..... 482/130; 482/123; 482/120

[58] Field of Search ..... 482/130, 129, 482/121, 123, 120, 114

[56] References Cited

U.S. PATENT DOCUMENTS

| | | | |
|---|---|---|---|
| 1,973,945 | 9/1934 | Chavin et al. | 482/130 |
| 3,567,219 | 3/1971 | Foster | 482/130 |
| 4,913,423 | 4/1990 | Farran et al. | 482/130 |
| 4,921,247 | 5/1990 | Sterling | 482/130 |
| 4,948,119 | 8/1990 | Robertson, Jr. | 482/130 |
| 5,080,353 | 1/1992 | Tench | 482/130 |
| 5,090,694 | 2/1992 | Pauls et al. | 482/130 |
| 5,324,243 | 6/1994 | Wilkinson | 482/129 |

*Primary Examiner*—Lynne A. Reichard
*Attorney, Agent, or Firm*—Bacon & Thomas

[57] ABSTRACT

A multi-purpose exercising apparatus includes a mounting base securely provided with a horizontal seat cushion and a vertical backrest. A hollow top side of a backrest tubular body at a rear side of said backrest is connected to two adjusting mechanisms which are respectively connected to a support arm. A tensile arm is disposed below the seat cushion at a front edge thereof. A damping mechanism is disposed within the mounting base. The damping mechanism consists of three resilient ropes wound around revolving shafts, in which two of the ropes respectively pass around pulley sets to be pulled out from their corresponding support arms. The two ropes are then fixedly connected to two rings or a lever. The third rope is fixedly connected to the tensile arm. By means of pressing a button of the adjusting mechanism to adjust the angles of the support arms, the user may exercise the triceps or muscles of the arms, chest, legs or abdomen as desired.

4 Claims, 7 Drawing Sheets

MULTI-PURPOSE EXERCISING APPARATUS

BACKGROUND OF THE INVENTION

With the prosperous development of the commercial society and the rise in people's living standard, people are seeking various ways to relief the pressure and strain from work and to maintain their mental and physical health. Sports and exercising are among the best choices. However, in places where land is expensive, recreational and sports few, traffic congested and air quality poor as in large cities, it is difficult to find a suitable site or sports or exercising. To solve such a problem modern people face, manufacturers have developed various kinds of exercising apparatuses for indoor use, such as exercise bikes, abdominal boards, leg presses, dipping stations, etc. Although such exercising apparatuses do satisfy modern people's need for keeping physical fitness, most of them have only a single function for exercising the muscles of a specific part of the body, and hence cannot provide multiple exercising effect and satisfy people's desire for variety. And if one wishes to exercise the muscles of various parts of the body, one needs to buy several exercising apparatuses offering different functions, which means a considerable sum of money. Certainly, these apparatuses will take up a lot of floor space too.

SUMMARY OF THE INVENTION

Therefore, a primary object of the present invention is to provide a multi-purpose exercising apparatus which may be used to exercise various parts of the body including the triceps, arms, chest, abdomen and legs, the multi-purpose exercising apparatus comprising adjusting mechanisms which may be utilized to change the angles of support arms, so that by pulling resilient ropes disposed in a mounting base and pulled through support arms and lifting a tensile arm appropriately located below a front edge of a seat cushion, the user may exercise the triceps or muscles of other parts of the body as desired, accomplishing multiple exercising effects.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
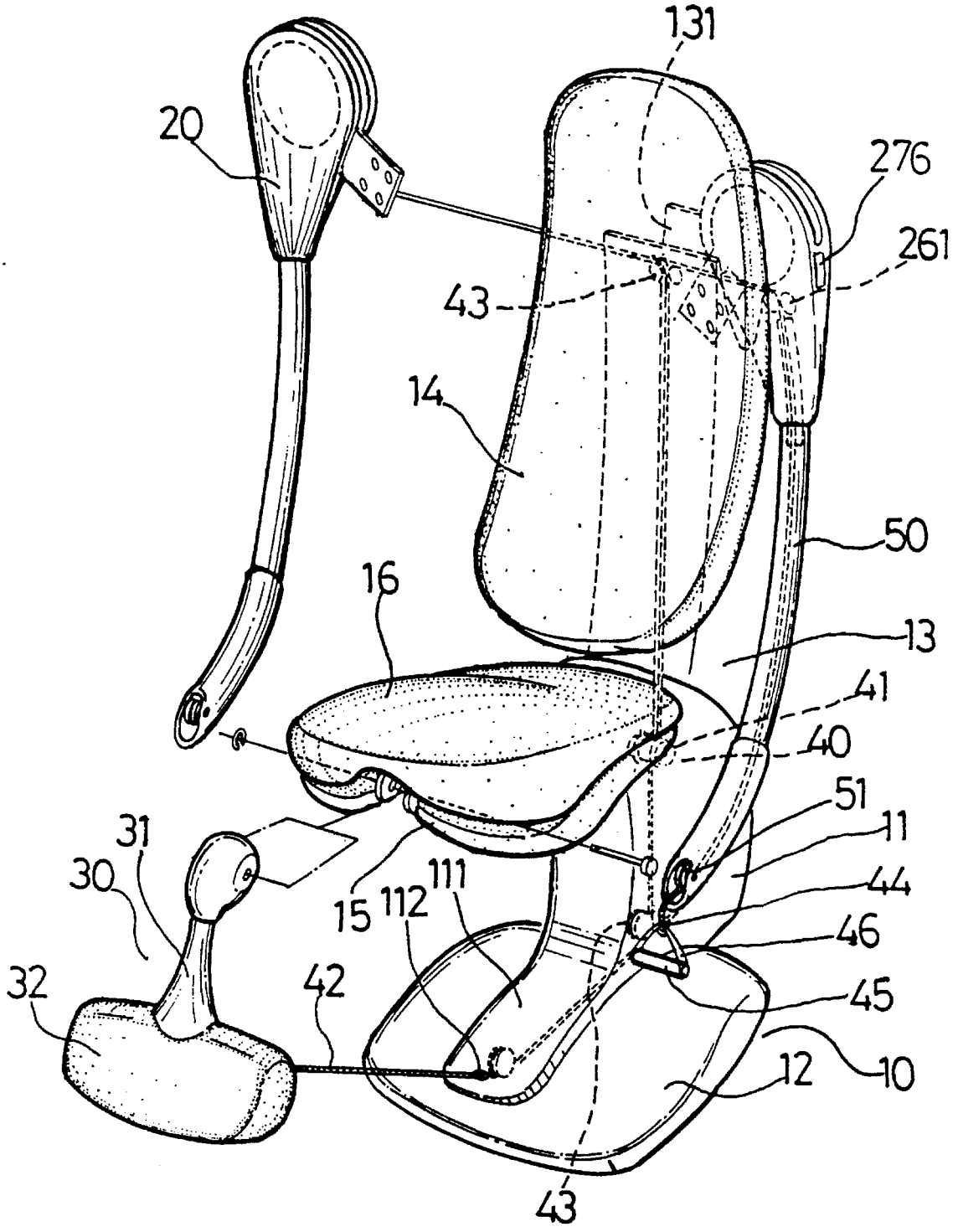
FIG. 1 is a perspective exploded view of a preferred embodiment of the present invention.

With reference to FIG. 1, the multi-purpose exercising apparatus according to the present invention mainly comprises a mounting base 10, two adjusting mechanisms 20, a tensile arm 30 and a damping mechanism 40.

The mounting base 10 includes a base body 11 which is a hollow body with an open top. A curved portion 111 at a bottom side of the mounting base 10 extends forwardly and has a through hole 112 in an end thereof. Below the curved portion is a securing base 12 having a top surface matching the curve of the curved portion 111. Both the base body 11 and the securing base 12 have a suitable weight. A backrest tubular body 13 and a backrest 14 fixedly disposed on the backrest tubular body 13 extend from the open top side of the base body 11. A hollow top side of the backrest tubular body 13 forms a recess 131. The adjusting mechanisms 20 are inserted into the backrest tubular body 13 via the recess 131 and are locked firmly therein. A seat frame 15 is horizontally disposed at a pre-determined height in front of the base body 11. A seat cushion 16 with a suitable resilience is fixedly secured on the upper side of the seat frame 15. A tensile arm 30 is pivotally mounted below the seat frame 15 at a front edge thereof. The tensile arm 30 consists of an arm 31 and a cushion 32 made of foamed material. An end of a rope 42 of a damping mechanism 40 disposed within the backrest tubular body 13 is fixedly connected to a lower side of the cushion 32 of the tensile arm 30.

Figure 2:
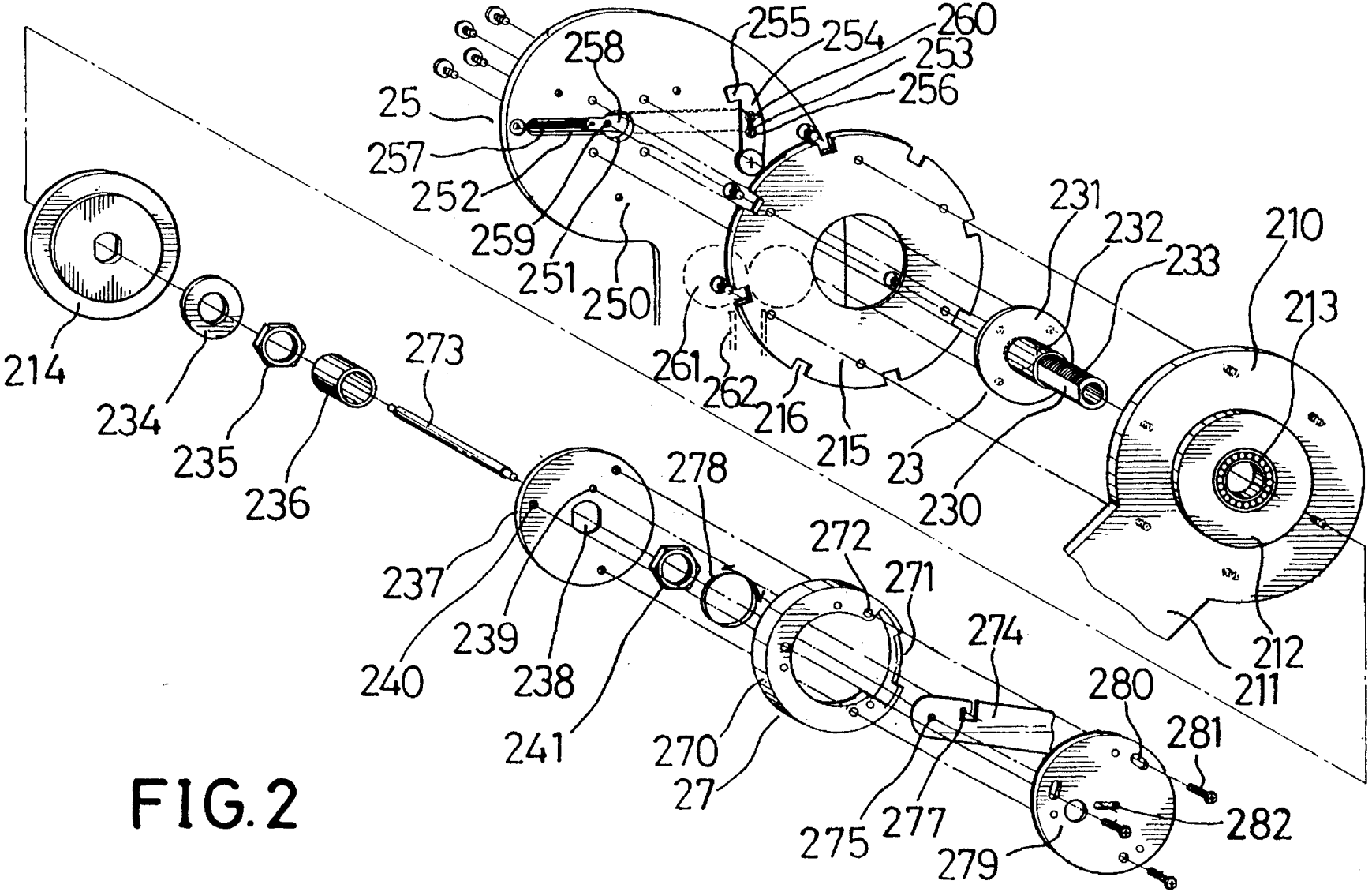
FIG. 2 is a perspective exploded view of an adjusting mechanism of the preferred embodiment according to the present invention.
Figure 3:
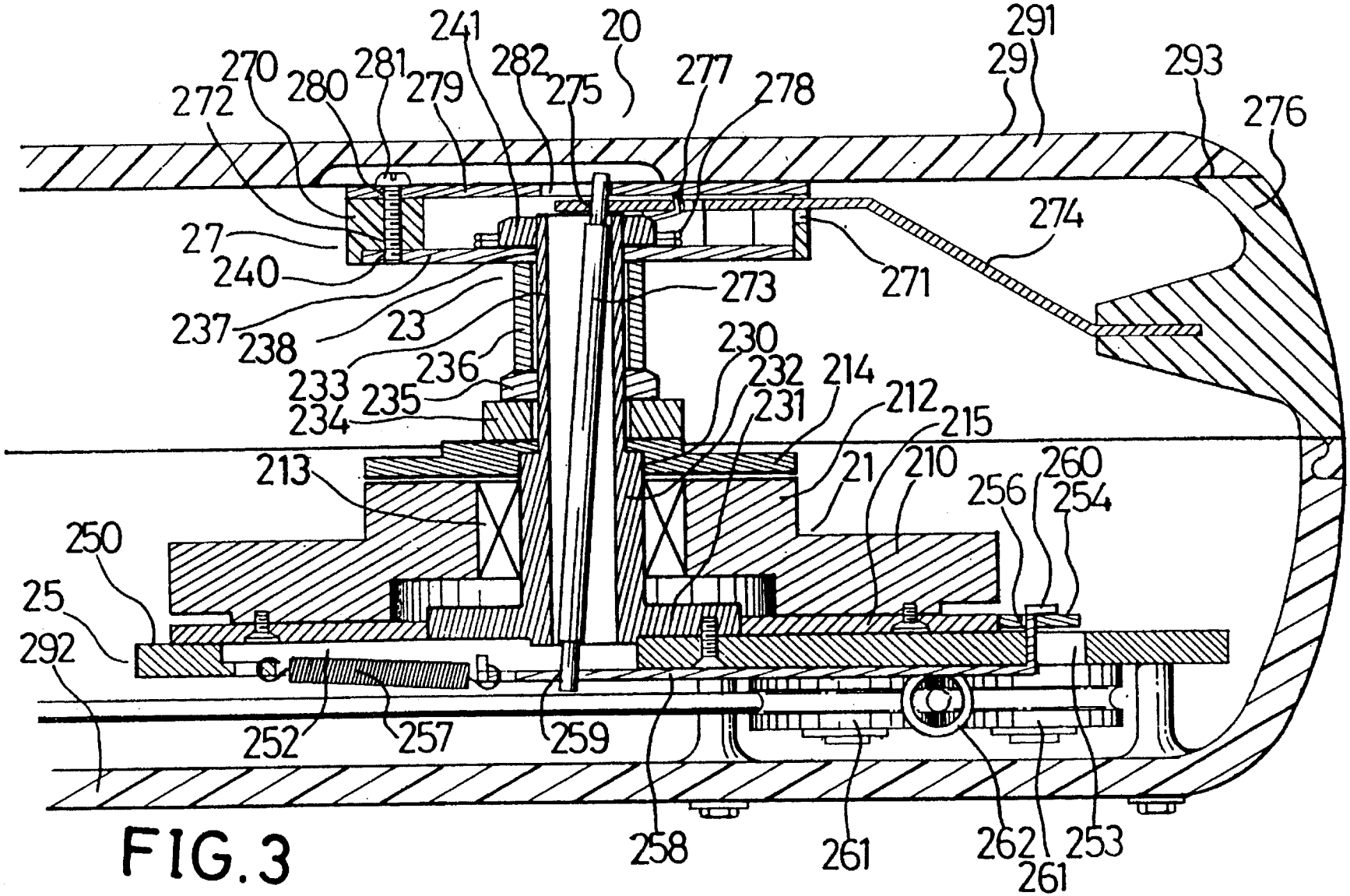
FIG. 3 is a sectional view of the adjusting mechanism of the preferred embodiment according to the present invention in an assembled state.

With reference to FIGS. 2 and 3, each of the adjusting mechanisms 20 comprises a brake device 21, a locking means 23, a limiting device 25, a control device 27 and a shell body 29.

The brake device 21 consists of a disc body 210 having one side thereof extending to form a securing plate 211. The securing plate 211 extends into the backrest tubular body 13 via the recess 131 and is locked firmly onto a wall of the backrest tubular body. 13 (see FIG. 1). The disc body 210 has a top portion which forms a ring 212 of a predetermined height. The middle of the ring 212 is fixedly provided with a ball bearing 213, and an abutting block 214 having a size equivalent to that of the ring 212 is arranged to cover a top side of the ball bearing 213. A toothed disc 215 is locked onto a bottom side of the disc body 210. Notches 216 equally spaced apart from each other by 45 degrees are formed around the circumference of the toothed disc 215.

The locking means 23 consists of a hollow screw 230 with two lateral hollow sides which passes upwardly through the toothed disc 215, the disc body 210, the ball bearing 213 and the abutting block 214 of the brake mechanism 21, so that a base disc 231 at the lower side of the screw 230 fits just into the middle of the toothed disc 215, with a cylindrical post 232 of the locking means 23 pressed into the middle of the ball bearing 213. A threaded portion 233 of the locking means 23 is fitted firstly through a ring packing 234 to lock with a first nut 235 so that the screw 230, ball bearing 213 and abutting block 214 are assembled as an integral structure. The threaded portion 233 is then fitted through a cylindrical block 236 and a circular iron sheet 237 to be locked with a second nut 241. The circular iron sheet 237 has a small hole 239 next to a round hole 238 which is disposed in the middle thereof for insertion of the threaded portion 233 therethrough.

The limiting device 25 consists of a plate body 250 which is locked onto the lower side of the base disc 231 of the screw 230. In the middle portion of the plate body 250 is a through hole 251. An elongated groove 252 is provided from the through hole 251 to a lateral side of the plate body 250. On an opposite side thereof and along the same horizontal line, a rectangular slot 253 is provided at a pre-determined position. A limiting arm 254 is pivotally provided at a suitable position obliquely below the rectangular slot 254. A retaining piece 255 is horizontally provided at a lateral side of a top portion of the limiting arm 254. A spring 257 is disposed in the elongated groove 252 with one end thereof fixedly connected to an end of the elongated groove 252 and the other end thereof pulling a strip 258. The strip 258 is provided with an insert hole 259 formed at the end pulled by the spring 257. The opposite end thereof is vertically provided an inverted-L shaped plate 260 which passes through the rectangular slot 253 and extends upwardly to project from a hole 256 of the limiting arm 254 which is in the shape of the numeral "8", so that the limiting arm 254 is subjected to the pulling force of the spring 257 under normal conditions to be in an oblique position. A pulley set 261 is pivotally provided at the back of the plate body 250 near its bottom end. Below the pulley set 261, a connecting tube 262 extends from a bottom edge of the plate body 250. The connecting tube 262 has an end thereof fixedly connected to a support arm 50. As shown in FIG. 1, the support arm 50 is a tubular body with two hollow ends. A free roller 51 is disposed within the support arm 50 near either orifices thereof.

The control device 27 has a plastic ring 270 of a suitable height covering the upper side of the circular iron sheet 237. A notch 271 is formed in one side of the plastic ring 270. A trigger lever 272 is inserted into the screw 230 with an end thereof fitted into the insert hole 259 of the strip 258 and the other end thereof fitted into a hole 275 of a push sheet 274 at a notch 271 of the plastic ring 270. The push sheet 274 is provided with a press button 276 on a side opposite to the hole 275. A hook portion 277 is formed in an upper side of the push sheet 274 for hooking an end of a resilient spring 278 which has the other end thereof positioned in the small hole 239 of the circular iron sheet 237. Then a securing plate 279 is fitted on the top side of the plastic ring 270. Screws 281 are fitted into holes 280 of the securing plate 279 through the screw holes 272 of the plastic ring 270 to be locked into holes 240 of the circular iron sheet 237. Additionally, an elongated hole 282 is horizontally provided in the middle of the securing plate 279 for left and right displacement of a top portion of the trigger lever 273.

The shell body 29 includes two corresponding upper and lower shells 291, 292. The lower shell 292 is locked to the bottom side of the plate body 250 of the limiting device 25, while the upper sheel 291 thereof is fitted on the top side of the securing plate 279 in the direction of the lower shell 291, so that the brake device 21, the locking means 23, the limiting device 25 and the control device 27 may be entirely enveloped. A slot 293 is formed in the other side of the upper shell 291 for accommodating the press button 276.

The damping device 40, as shown in FIG. 1, consists of a revolving shaft 41 axially provided at a suitable position of a wall of the base body 11. Three resilient ropes 42 are wound around the revolving shaft 41, in which two of the ropes 42 extend upwardly to be respectively pulled out from each of the two support arms 50 via the pulley set 261 of the limiting device 25 by means of the steering of the free rollers 43. Both ropes have one of their ends connected to a retainer element 44. Both ends of the two ropes are connected to rings 46 of pull rings 45 or lugs of a lever, in which one of the ropes 42 extends downwardly to pass around the free roller 43 to be pulled out through the through hole 112 of the base body 11, and an end of the rope is firmly tied to the lower side of the cushion 32 of the tensile arm 30.

Figure 4:
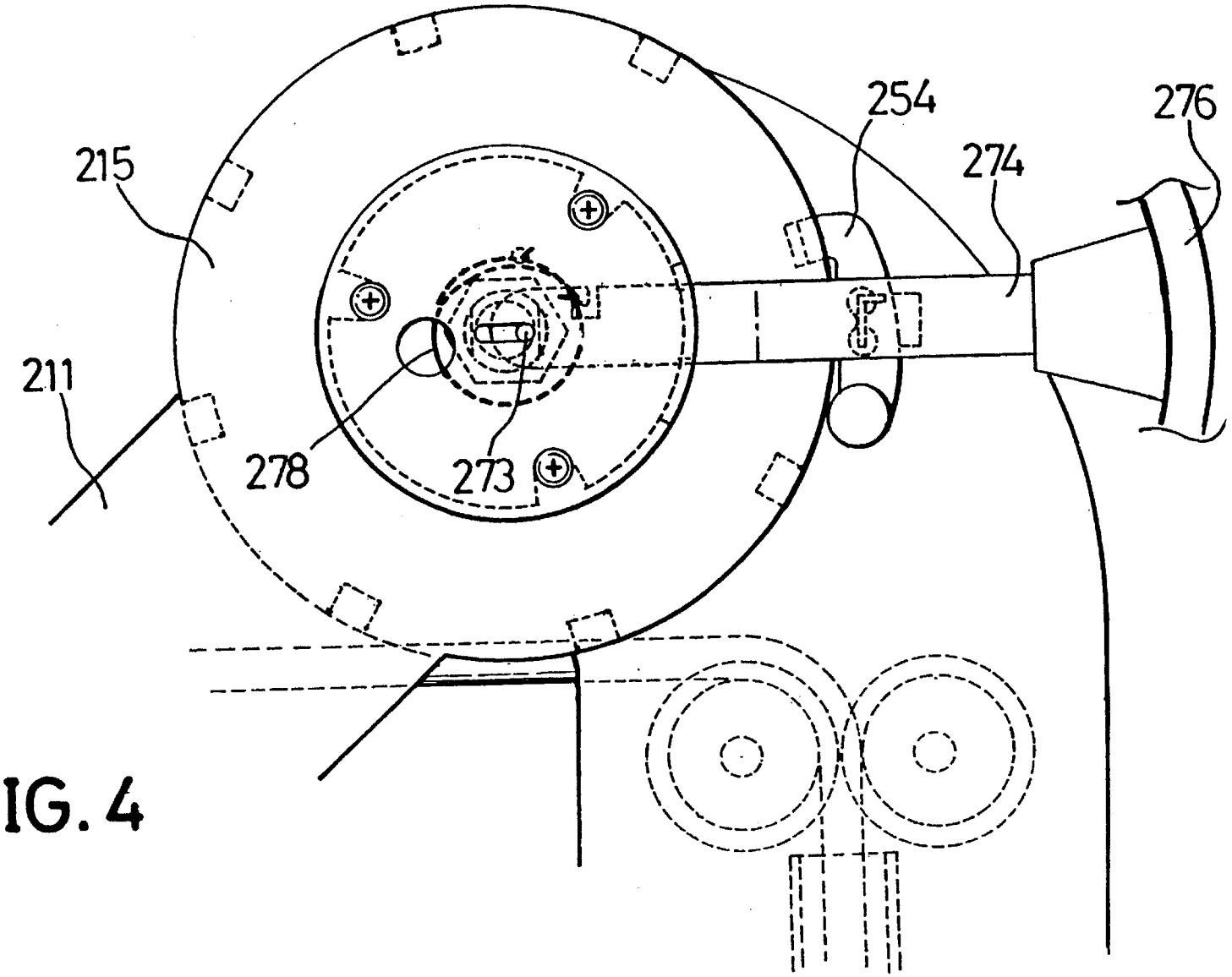
FIG. 4 is sectional view of the adjusting mechanism of the preferred embodiment according to the present invention in part.
Figure 5:
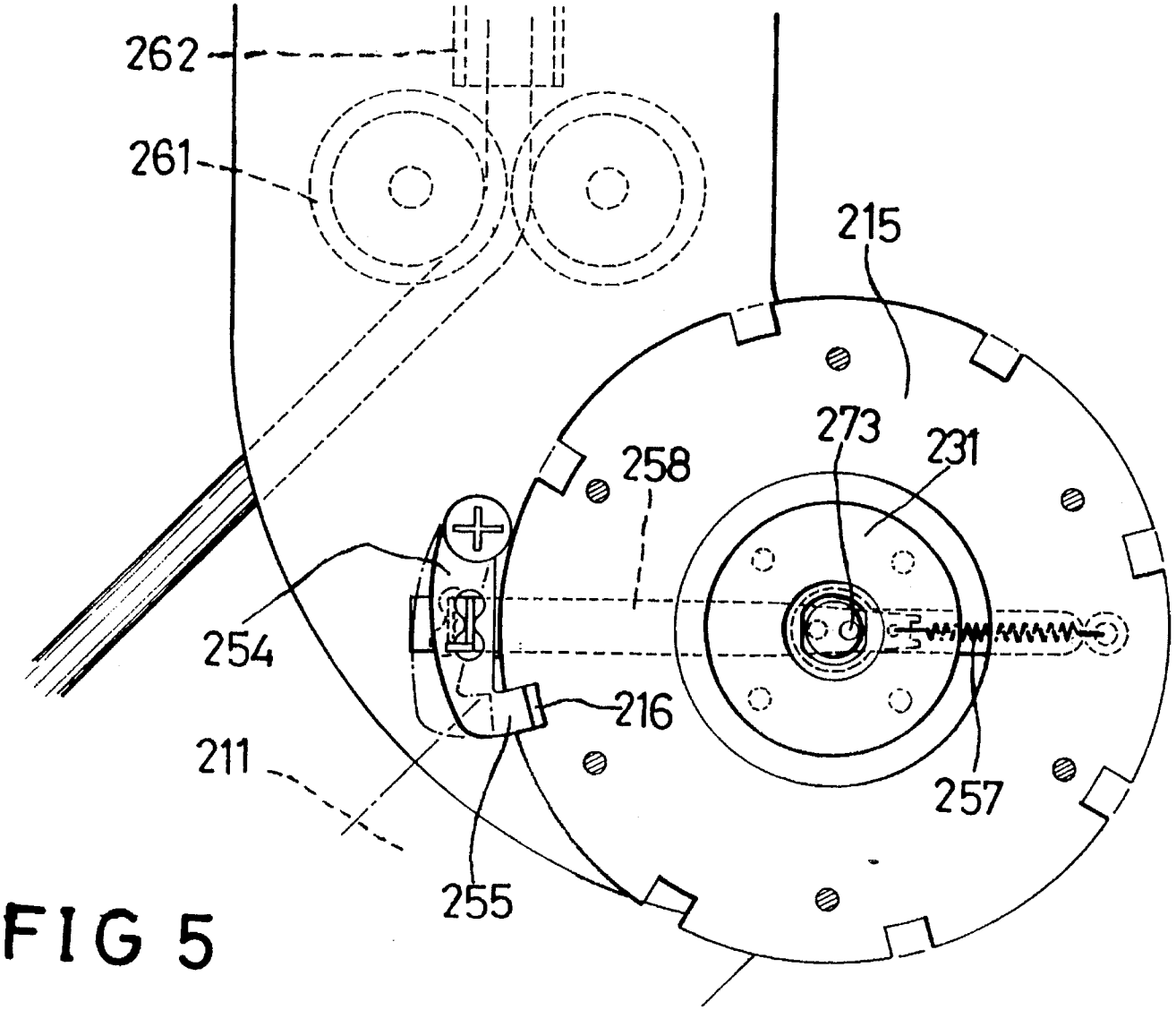
FIG. 5 is a schematic view showing the working of the adjusting mechanisms of the preferred embodiment according to the present invention.

The structure of the components and their relative locations of the preferred embodiment according to the present invention are described as above. By means of the above-described construction, the user may utilize the adjusting mechanisms to adjust the angles of the support arms as desired to exercise various parts of the body. The manner of adjustment and the action of the components will be described below. With reference to FIGS. 4 and 5, by means of the press button 276 of the control device 27 pushing inwardly and the push sheet 274 fixedly connecting the press button 276 and pushing the top portion of the trigger lever 273 inwardly, the bottom end of the trigger lever 273 pushes outwardly against the strip 258 of the limiting device 25. The strip 258 brings the limiting arm 254 to turn outwardly in the manner assembling the shape of a fan. At this time, under the condition that the press button 276 is being pressed inwardly, the support arm 50 may be turned through a pre-determined angle by turning it upwardly or downwardly, and when the press button 276 is released, the bottom end of the trigger lever 273 is subject to the resilient force of the spring 257 and is moved inwardly, bringing a retaining piece 255 of the limiting arm 254 to be engaged in another slot 216 on the toothed disc 215 so that the support arm 50 may be properly positioned.

Figure 6:
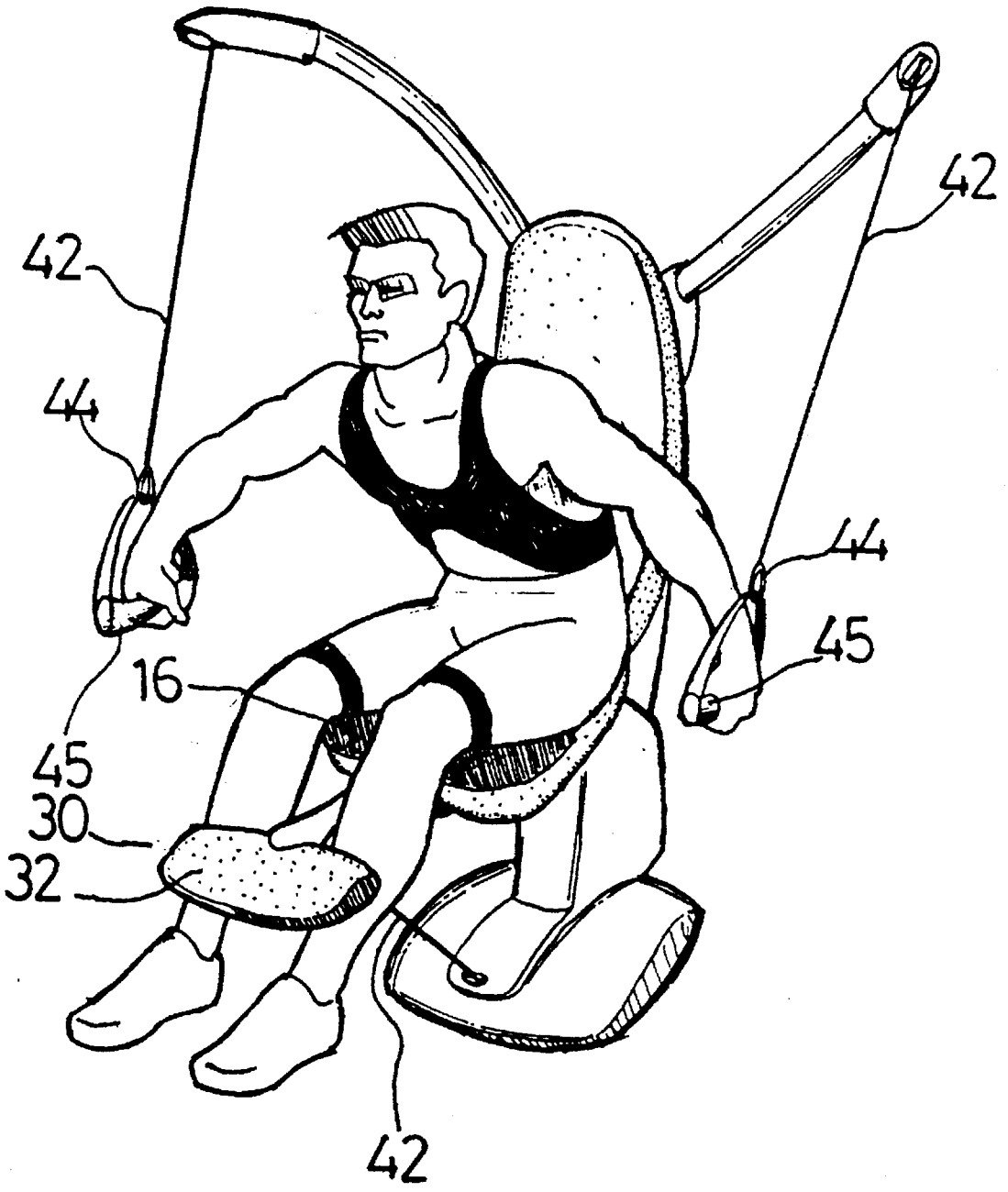
FIG. 6 is a schematic view showing the preferred embodiment of the present invention in use.
Figure 7:
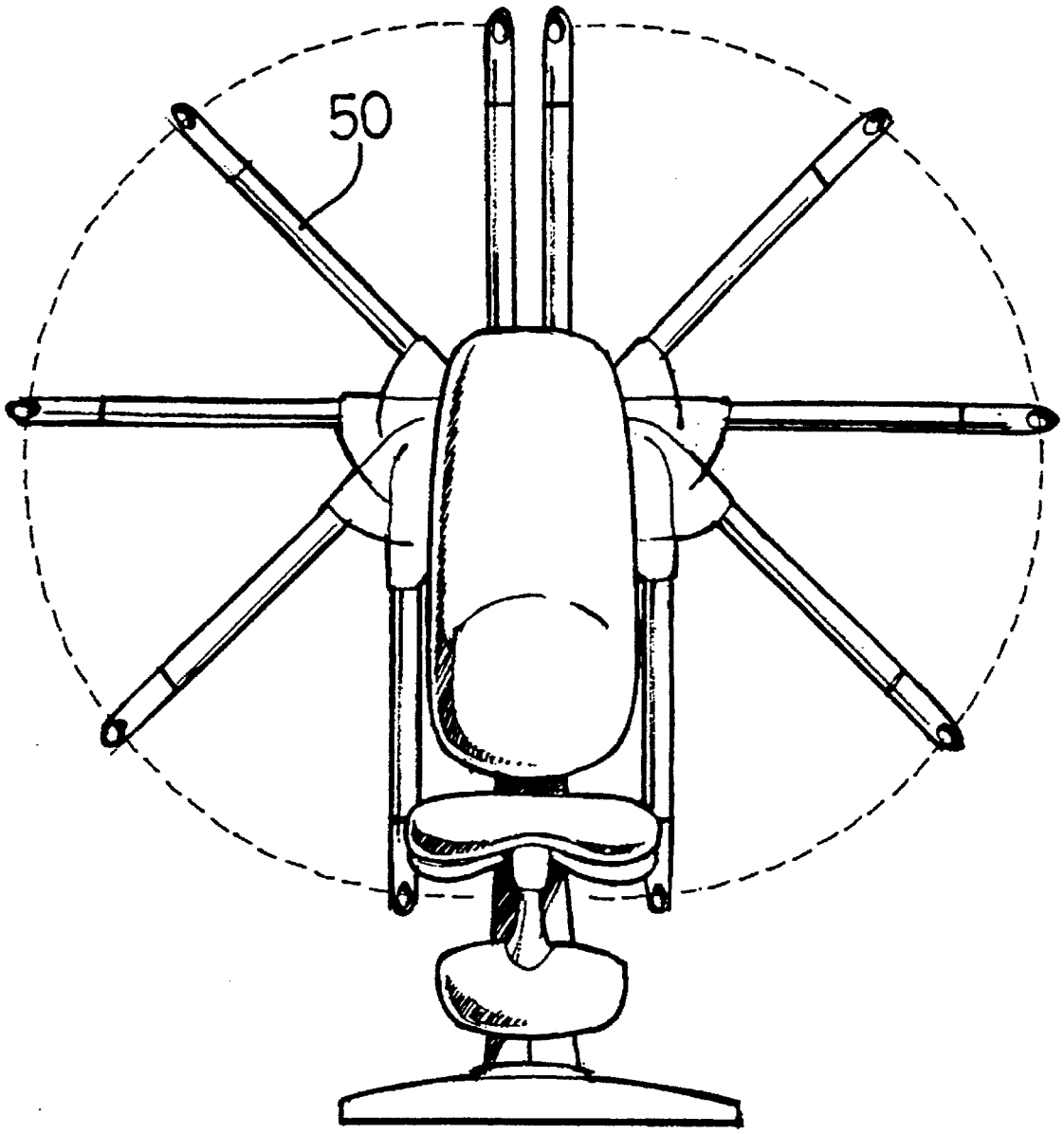
FIG. 7 is schematic view showing the adjusting mechanisms of the preferred embodiment according to the present invention at various positioning angles.

Furthermore, with reference to FIG. 6, the user is seated on the seat cushion 16, with each hand gripping a pull ring 45 and pulling it downwardly, by means of the ropes 42 which pull in the opposite direction, the user's chest and arms are exercised. At the same time, the user may extend his legs to below the cushion 32 of the tensile arm 30; by lifting the cushion 32 of the tensile arm 30 with the legs, the user's leg and abdominal muscles may be exercised. Additionally, the user may freely adjust the support arms 50 to desired angles such as shown in FIG. 7, in which the support arms 50 my be positioned vertically upward or downward, or turned through 45 degrees or 135 degrees or disposed horizontally, so as to enable the user to pull the ropes upwardly, downwardly, or forwardly to exercise various parts of the body.

In view of the foregoing, the multi-purpose exercising apparatus of the present invention employs an adjusting mechanism which enables angle adjustment of the support arms, so that the user may pull the lever or the rings outwardly, upwardly or downwardly with the hands, or lift the tensile arm upwardly with the legs, so as to train the triceps, arms, chest, abdomen or legs as desired.

Although the present invention has been illustrated and described with reference to the preferred embodiment thereof, it should be understood that it is in no way limited to the details of such embodiment but is capable of numerous modifications within the scope of the appended claims.

What is claimed is:

1. A multi-purpose exercising apparatus comprising:

a mounting base having a securing base with a curved top surface disposed at a bottom side of a hollow body thereof, said body having a backrest tubular body upwardly and vertically disposed at a top portion thereof and a backrest firmly secured to said tubular body, a seat cushion being horizontally mounted at a pre-determined height in front of said body of said mounting base, and a tensile arm being pivotally disposed below said seat cushion at a front edge thereof, said tensile arm having a cushion disposed at a front end of an arm thereof;

two adjusting mechanisms, each of said adjusting mechanisms consisting of a brake device, a locking means, a limiting device, a control device and a shell body, said brake device having a disc body with one side thereof extending to form a securing plate for locking firmly onto a wall of said tubular body, said limiting device being pivotally provided with a pulley set at a rear side of a plate body near its bottom end, a connecting tube extending from a bottom edge of said plate body below said pulley set, said connecting tube having a bottom end thereof fixedly connected to one of two support arms;

a damping device consisting of a revolving shaft provided at a suitable position of a wall of said tubular body, three resilient ropes being wound around said revolving shaft, in which two of said ropes extend upwardly to be pulled out individually from their corresponding support arms via said pulley set on said limiting device by means of the steering of a plurality of free rollers, said two ropes respectively having one of their ends connected to a retainer element which is connected to a pull ring, in which one of said three ropes extends downwardly to be pulled out through a through hole of said base body via the steering of said free rollers, an end of said one of said three ropes being firmly tied to a lower side of said cushion of said tensile arm;

by means of utilizing said adjusting mechanism to adjust the angles of said support arms and pulling said resilient ropes extending via said support arms, or lifting said tensile arm pivotally provided at the front edge of said seat cushion, the triceps, arms, chest, abdomen and legs of the user may be exercised.

2. A multi-purpose exercising apparatus as claimed in claim 1, wherein a ball bearing is disposed in a ring in the middle of said disc body of said brake element with an abutting block covering a top side thereof and a toothed disc is firmly locked to a bottom side of said disc body, a cylindrical post of a hollow screw of said locking means pressing against said ball bearing, a threaded portion of said locking means projecting from an upper edge of said abutting block and fitting in sequence into a first nut, a cylindrical block, an iron sheet and a second nut; said limiting device has a plate body locked below a base disc of said screw, a spring in the middle of said plate body pulls a strip and a limiting arm to engage in a notch of said toothed disc; said control device has a plastic ring covering an upper side of said iron sheet and a trigger lever inserted into said screw, with a bottom end of said trigger lever fitted into an insert hole provided in one side of said strip and a top end thereof fitted into an insert hole of a push sheet of a notch of said plastic ring, said push sheet having a press button disposed opposite to said insert hole thereof, a securing plate being provided on a top side of said plastic ring and locked firmly thereon, said securing plate having an elongated hole disposed in the middle thereof for displacement of said trigger lever; and said shell body consisting of an upper shell and a lower shell for enveloping said braking device, said locking means, said limiting device and said control device as an integral whole.

3. A multi-purpose exercising apparatus as claimed in claim 1 or 2, wherein said toothed disc is provided with a plurality of notches equally spaced apart by 45 degrees.

4. A multi-purpose exercising apparatus as claimed in claim 1, wherein the ends of said ropes pulled out from said two support arms are connected to a lever.

* * * * *